US009784543B2

(12) United States Patent
Roemerman et al.

(10) Patent No.: US 9,784,543 B2
(45) **Date of Patent: *Oct. 10, 2017**

(54) WEAPON AND WEAPON SYSTEM EMPLOYING THE SAME

(71) Applicant: Lone Star IP Holdings, LP, Addison, TX (US)

(72) Inventors: Steven D. Roemerman, Highland Village, TX (US); John P. Volpi, Garland, TX (US)

(73) Assignee: Lone Star IP Holdings, LP, Addison, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/747,089

(22) Filed: Jun. 23, 2015

(65) Prior Publication Data

US 2016/0047639 A1 Feb. 18, 2016

Related U.S. Application Data

(63) Continuation of application No. 13/451,404, filed on Apr. 19, 2012, now Pat. No. 9,068,803.

(60) Provisional application No. 61/477,019, filed on Apr. 19, 2011.

(51) Int. Cl.

| | |
|---|---|
| ***F42B 12/40*** | (2006.01) |
| ***F42B 8/20*** | (2006.01) |
| ***F42B 8/22*** | (2006.01) |
| ***F42B 7/02*** | (2006.01) |
| ***F42B 12/48*** | (2006.01) |
| ***F42B 4/02*** | (2006.01) |
| ***F42B 10/60*** | (2006.01) |

(52) U.S. Cl.
CPC ..... *F42B 12/40* (2013.01); *F42B 4/02* (2013.01); *F42B 8/20* (2013.01); *F42B 8/22* (2013.01); *F42B 10/60* (2013.01); *F42B 12/48* (2013.01)

(58) Field of Classification Search
CPC ..... F42B 8/00; F42B 8/12; F42B 8/14; F42B 8/20; F42B 8/22; F42B 8/24; F42B 4/04; F42B 4/02; F42B 12/40; F42B 12/46; F42B 12/48; F42B 12/50
USPC ..... 102/334, 367, 368, 369, 370, 395, 444, 102/445, 498, 513, 529
See application file for complete search history.

(56) References Cited

U.S. PATENT DOCUMENTS

| | | | | |
|---|---|---|---|---|
| 1,765,017 A * | 6/1930 | Marie | F42B 8/22 | 102/395 |
| 2,737,889 A | 3/1956 | Barker et al. | | |
| 3,094,934 A * | 6/1963 | Anthony | F42B 8/20 | 102/445 |
| 3,387,606 A | 6/1968 | Crafts et al. | | |
| 3,440,963 A * | 4/1969 | De Luca | F42B 12/48 | 102/513 |
| 3,626,415 A | 12/1971 | Montgomery et al. | | |

(Continued)

FOREIGN PATENT DOCUMENTS

GB 2280736 A 2/1995

*Primary Examiner* — James S Bergin
(74) *Attorney, Agent, or Firm* — Boisbrun Hofman, PLLC

(57) ABSTRACT

A weapon system including a weapon, and methods of manufacturing and operating the same. In one embodiment, the weapon includes a guidance section in a front section of the weapon, and a signal cartridge assembly behind the front section and including a signal cartridge configured to provide a signal indicating a location of impact for the weapon.

16 Claims, 5 Drawing Sheets

(56) References Cited

U.S. PATENT DOCUMENTS 3,635,162 A * 1/1972 Lohkamp ..... F42B 8/22 102/395
3,739,726 A 6/1973 Pintell
3,786,757 A 1/1974 Goldstein et al.
4,063,508 A 12/1977 Whiting
4,109,579 A * 8/1978 Carter ..... F42B 8/20 102/373
4,112,843 A * 9/1978 Laviolette ..... F42B 8/22 102/395
4,408,537 A * 10/1983 Fortier ..... F42B 8/22 102/395
4,498,394 A 2/1985 Regebro
5,034,686 A 7/1991 Aspelin
5,088,381 A 2/1992 Lamarque et al.
5,107,767 A 4/1992 Schneider et al.
H1048 H 5/1992 Wilson et al.
5,461,982 A * 10/1995 Boyer, III ..... F42B 12/40 102/473
5,691,502 A 11/1997 Craddock et al.
6,349,898 B1 2/2002 Leonard et al.
6,523,478 B1 * 2/2003 Gonzalez ..... F42B 30/04 102/216
6,691,947 B2 2/2004 La Fata
7,032,858 B2 4/2006 Williams
7,121,210 B2 10/2006 Steele
7,958,810 B2 6/2011 Roemerman et al.
8,502,126 B2 8/2013 Tyree
8,541,724 B2 9/2013 Roemerman
8,661,980 B1 3/2014 Roemerman et al.
8,661,981 B2 3/2014 Roemerman et al.
2003/0051629 A1 3/2003 Zavitsanos et al.
2003/0056680 A1 * 3/2003 Santacreu ..... F42B 4/12 102/334
2003/0146342 A1 8/2003 Hellman
2003/0192992 A1 10/2003 Olsen et al.
2004/0174261 A1 9/2004 Volpi et al.
2005/0274844 A1 12/2005 Stuhr
2006/0077036 A1 4/2006 Roemerman et al.
2007/0157843 A1 7/2007 Roemerman et al.
2008/0062412 A1 3/2008 Kravitz
2009/0026321 A1 1/2009 Sarh et al.
2009/0078146 A1 3/2009 Tepera et al.
2009/0100995 A1 4/2009 Fisher
2009/0228159 A1 9/2009 Flowers et al.
2009/0283643 A1 11/2009 Sar et al.
2010/0031841 A1 2/2010 Michel et al.
2010/0264253 A1 10/2010 Taylor et al.
2010/0282893 A1 11/2010 Roemerman et al.
2010/0326264 A1 12/2010 Roemerman et al.
2011/0017864 A1 1/2011 Roemerman et al.
2011/0179963 A1 7/2011 Tepera et al.
2011/0233322 A1 9/2011 Holicki et al.
2012/0152091 A1 6/2012 Roemerman et al.
2012/0199689 A1 8/2012 Burkland
2012/0292431 A1 11/2012 Patel et al.
2014/0026777 A1 1/2014 Tepera et al.

* cited by examiner

WEAPON AND WEAPON SYSTEM EMPLOYING THE SAME

This application is a Continuation of U.S. patent application Ser. No. 13/451,404 entitled, "Weapon and Weapon System Employing the Same", filed on Apr. 19, 2012 which is currently allowed, which claims the benefit of U.S. Provisional Application No. 61/477,019 entitled "Weapon Training System and Internal Marker Cartridge," filed Apr. 19, 2011, which application is incorporated herein by reference.

TECHNICAL FIELD

The present invention is directed, in general, to weapon systems and, more specifically, to a weapon system including a weapon, and methods of manufacturing and operating the same.

BACKGROUND

Weapons including practice bombs are often employed to simulate the ballistic properties of service bombs used in combat. Since practice bombs contain no explosive filler, a practice bomb signal cartridge can be used for visual observation of weapon-target impact. The signal cartridges provide a flash, smoke (or smoke like signal) and/or a dye effect, providing a mechanism of locating the impact of the practice bomb in daylight, in darkness and in water.

The primary purpose of practice bombs is safety when training new or inexperienced pilots and ground-handling crews. Other advantages of practice bombs include their low cost and an increase in available target locations due primarily to reduced safety requirements because of a lack of an active warhead. These bombs provide full-scale training for assembly and loading crews and pilots. The general types of practice bombs are subcaliber or full-scale practice bombs. Subcaliber means that the practice bomb is much smaller in size and weight than the service bomb it simulates. Full-scale practice bombs are representative of service bombs in their size and weight.

As mentioned above, there is a need to configure the practice bombs to emulate the operation of the service bombs. The presently available practice bombs suffer from deficiencies such as the arrangement of the signal cartridge therein. This can be because newer practice bombs often incorporate additional homing and guiding capabilities to better emulate the actual weapon. What is needed in the art, therefore, is a weapon in the form of a practice bomb that overcomes the deficiencies in the prior art.

SUMMARY OF THE INVENTION

These and other problems are generally solved or circumvented, and technical advantages are generally achieved, by advantageous embodiments of the present invention, which includes a weapon system including a weapon, and methods of manufacturing and operating the same. In one embodiment, the weapon includes a guidance section in a front section of the weapon, and a signal cartridge assembly behind the front section and including a signal cartridge configured to provide a signal indicating a location of impact for the weapon.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

The present disclosure is related to weapons systems and may incorporate RFID systems as well. For exemplary weapons and weapons systems, see U.S. patent application Ser. No. 10/841,192 entitled "Weapon and Weapon System Employing The Same," to Roemerman, et al., filed May 7, 2004, U.S. Pat. No. 7,530,315 entitled "Weapon and Weapon System Employing the Same," to Tepera, et al., issued May 5, 2009, and U.S. Pat. No. 8,117,955 entitled "Weapon Interface System and Delivery Platform Employing the Same," to Roemerman, et al., issued Feb. 21, 2012, which are incorporated herein by reference. Additionally, a related weapon and weapon system is provided in U.S. Patent Application Publication No. 2011/0017864 entitled "Small Smart Weapon and Weapon System Employing the Same," published January 27, which is a continuation in part of U.S. Pat. No. 7,895,946 entitled "Small Smart Weapon and Weapon System Employing the Same," issued Mar. 1, 2011, which is a continuation-in-part of U.S. Pat. No. 7,690,304 entitled "Small Smart Weapon and Weapon System Employing the Same," issued Apr. 6, 2010, which are incorporated herein by reference. For examples of RFID systems, see U.S. Patent Application Publication No. 2007/0035383, entitled "Radio Frequency Identification Interrogation Systems and Methods of Operating the Same," to Roemerman, et al., published Feb. 15, 2007, U.S. Pat. No. 7,019,650 entitled "Interrogator and Interrogation System Employing the Same," to Volpi, et al., issued on Mar. 28, 2006, U.S. Pat. No. 7,501,948, entitled "Interrogation System Employing Prior Knowledge About An Object To Discern An Identity Thereof," to Roemerman, et al., issued Mar. 10, 2009, U.S. Patent Application Publication No. 2006/0017545, entitled "Radio Frequency Identification Interrogation Systems and Methods of Operating the Same," to Volpi, et al., published Jan. 26, 2006, U.S. Patent Application Publication No. 2005/0201450, entitled "Interrogator And Interrogation System Employing The Same," to Volpi, et al., published Sep. 15, 2005, and U.S. Pat. No. 8,063,760, entitled "Interrogator and Interrogation System Employing the Same," to Volpi, et al., issued Nov. 22, 2011, all of which are incorporated herein by reference.

Figure 1:
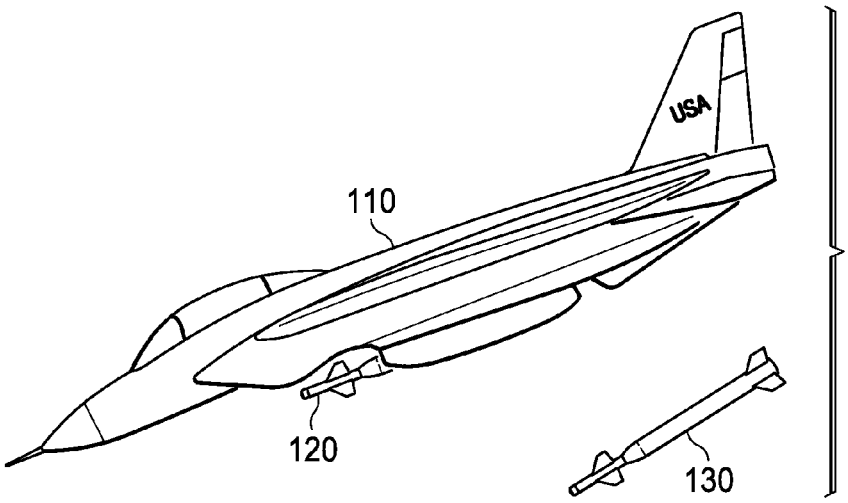
FIG. 1 illustrates a view of an embodiment of a weapon system.

Referring initially to FIG. 1, illustrated is a view of an embodiment of a weapon system in accordance with the principles of the present invention. The weapon system includes a delivery vehicle (e.g., an airplane such as an F-14) 110 and at least one weapon. As demonstrated, a first weapon 120 is attached to the delivery vehicle and a second weapon 130 is deployed from the delivery vehicle 110 intended for a target.

The weapon system is configured to provide total energy as derived, without limitation, from a velocity and altitude of the delivery vehicle 110 in the form of kinetic energy and potential energy to the first and second weapons 120, 130 and, ultimately, the warhead, submunitions and any contents (such as darts) therein. The first and second weapons 120, 130 when released from the delivery vehicle 110 provide guided motion for the warhead, submunitions and darts to the target. The total energy transferred from the delivery vehicle 110 as well as any additional energy acquired through the first and second weapons 120, 130 through propulsion, gravity or other parameters provides the kinetic energy to the warhead to perform the intended mission. While the first and second weapons 120, 130 described with respect to FIG. 1 represent precision guided weapons, those skilled in the art understand that the principles of the present invention also apply to other types of weapons including weapons that are not guided by guidance technology or systems. While this discussion supports actual weapons it illustrates the need for test weapons of similar capability as regards dynamics and guidance capabilities.

Figure 2:
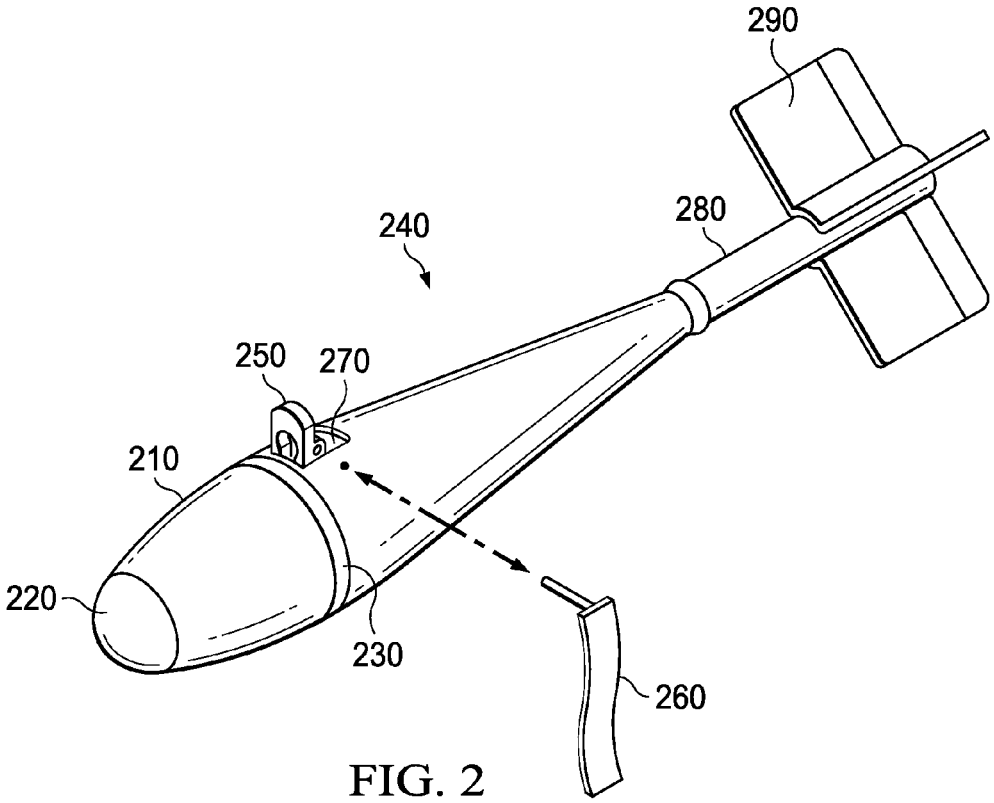
FIG. 2 illustrated is a perspective view of an embodiment of a weapon employable in a weapon system.

Turning now to FIG. 2, illustrated is a perspective view of an embodiment of a weapon employable in a weapon system. The weapon includes a guidance section 210 including a target sensor (e.g., a laser seeker) 220, and guidance and control electronics and logic to guide the weapon to a target. The target sensor 220 may include components and subsystems such as a crush switch, a semi-active laser based terminal seeker ("SAL") quad detector, a net cast corrector and lenses for an optical system. In accordance with SAL systems, net cast optics are suitable, since the spot for the terminal seeker is normally defocused.

The guidance section 210 may include components and subsystems such as a global positioning system ("GPS"), an antenna such as a ring antenna 230 (e.g., dual use handoff and data and mission insertion similar to radio frequency identification and potentially also including responses from the weapon via similar means), a multiple axis microelectomechanical gyroscope, safety and arming devices, fuzing components, a quad detector, a communication interface [e.g., digital subscriber line ("DSL")], and provide features such as low power warming for fast acquisition and inductive handoff with a personal information manager. In the illustrated embodiment, the antenna 230 is about a surface of the weapon. Thus, the antenna 230 is configured to receive mission data such as location, laser codes, GPS ephemerides and the like before launching from a delivery vehicle to guide the weapon to a target. The antenna is also configured to receive instructions after launching from the delivery vehicle to guide the weapon to the target. The weapon system, therefore, includes a communication system, typically within the delivery vehicle, to communicate with the weapon, and to achieve other goals and ends in the context of weapon system operation. It should be understood that the guidance section 210 contemplates, without limitation, laser guided, GPS guided, and dual mode laser and GPS guided systems. It should be understood that this antenna may be configured to receive various kinds of electromagnetic energy, just as there are many types of RFID tags that are configured to receive various kinds of electromagnetic energy.

The weapon also includes a warhead 240 (e.g., a unitary configuration) having destructive elements (formed from explosive or non-explosive materials), mechanisms and elements to articulate aerodynamic surfaces. A folding lug switch assembly 250, safety pin 260 and cavity 270 are also coupled to the guidance section 210 and the warhead 240. The guidance section 210 is in front of the warhead 240. As addressed below, for a test weapon using the principles of a signal cartridge assembly, the area of the warhead 240 can be used for the signal cartridge assembly and a test weapon of similar dynamics, but of lesser cost and greater safety can be configured. The folding lug switch assembly 250 projects from a surface of the weapon. The weapon still further includes an aft section 280 behind the warhead 240 including system power elements, a ballast, actuators, flight control elements, and tail fins 290.

For instances when the target sensor 220 is a laser seeker, the laser seeker detects the reflected energy from a selected target which is being illuminated by a laser. The laser seeker provides signals so as to drive the control surfaces in a manner such that the weapon is directed to the target. The tail fins 290 provide both stability and lift to the weapon. Modern precision guided weapons can be precisely guided to a specific target so that considerable explosive energy is often not needed to destroy an intended target. In many instances, kinetic energy discussed herein may be sufficient to destroy a target, especially when the weapon can be directed with sufficient accuracy to strike a specific designated target.

The destructive elements of the warhead 240 may be constructed of non-explosive materials and selected to achieve penetration, fragmentation, or incendiary effects. The destructive elements (e.g., shot) may include an incendiary material such as a pyrophoric material (e.g., zirconium) therein. The term "shot" generally refers a solid or hollow spherical, cubic, or other suitably shaped element constructed of explosive or non-explosive materials, without the aerodynamic characteristics generally associated with, for instance, a "dart." The shot may include an incendiary material such as a pyrophoric material (e.g., zirconium) therein. Inasmuch as the destructive elements of the warhead are a significant part of the weapon, the placement of these destructive elements, in order to achieve the overall weight and center of gravity desired, is an important element in the design of the weapon.

The non-explosive materials applied herein are substantially inert in environments that are normal and under benign conditions. Nominally stressing environments such as experienced in normal handling are generally insufficient to cause the selected materials (e.g., tungsten, hardened steel, zirconium, copper, depleted uranium and other like materials) to become destructive in an explosive or incendiary manner. The latent lethal explosive factor is minimal or non-existent. Reactive conditions are predicated on the application of high kinetic energy transfer, a predominantly physical reaction, and not on explosive effects, a predominantly chemical reaction.

The folding lug switch assembly 250 is typically spring-loaded to fold down upon release from, without limitation, a rack on an aircraft. The folding lug switch assembly 250 permits initialization after launch (no need to fire thermal batteries or use other power until the bomb is away) and provides a positive signal for a fuze. The folding lug switch assembly 250 is consistent with the laser guided bomb ("LGB") strategy using lanyards, but without the logistics issues of lanyards. The folding lug switch assembly 250 also makes an aircraft data and power interface optional and supports a visible "remove before flight" pin. The folding lug switch assembly 250 provides a mechanism to attach the weapon to a delivery vehicle and is configured to close after launching from the delivery vehicle thereby satisfying a criterion to arm the warhead. It should be understood, however, that the folding lug switch assembly 250, which is highly desirable in some circumstances, can be replaced with other means of carriage and suspension, and is only one of many features of the present invention, which can be applied in different combinations to achieve the benefits of the weapon system.

Typically, the safety pin 260 is removed from the folding lug switch assembly 250 and the folding lug switch assembly 250 is attached to a rack of an aircraft to hold the folding lug switch assembly 250 in an open position prior to launch. Thus, the safety pin 260 provides a mechanism to arm the weapon. Once the weapon is launched from the aircraft, the folding lug switch assembly 250 folds down into the cavity 270 and provides another mechanism to arm the weapon. A delay circuit between the folding lug switch assembly 250 and the fuze may be yet another mechanism to arm or provide time to disable the weapon after launch. Therefore, there are often three mechanisms that are satisfied before the weapon is ultimately armed enroute to the target.

A number of circuits are now well understood that use power from radio frequency or inductive fields to power a receiving chip and store data. The antenna includes an interface to terminate with the aircraft interface at the rack for loading relevant mission data including target, location, laser codes, GPS ephemerides and the like before being launched. Programming may be accomplished by a hand-held device similar to a fuze setter or can be programmed by a lower power interface between a rack and the weapon. Other embodiments are clearly possible to those skilled in the art. The antenna serves a dual purpose for handoff and GPS. In other words, the antenna is configured to receive instructions after launching from the delivery vehicle to guide the weapon to the target. Typically, power to the weapon is not required prior to launch, therefore no umbilical cable is needed. Alternative embodiments for power to GPS prior to launch are also contemplated herein.

The modular design of the weapon allows the introduction of features such as GPS and other sensors as well. Also, the use of a modular warhead 240 with heavy metal ballast makes the low cost kinetic [no high explosives ("HE")] design option practical and affordable.

As illustrated in an exemplary embodiment of a weapon in the TABLE 1 below, the weapon may be designed to have a similar envelope, mass, and center of gravity already present in existing aircraft for a practice bomb version thereof. Alternatively, the weapon may be designed with other envelopes, masses, and centers of gravity, as may be available with other configurations, as also being included within the constructs of this invention.

TABLE 1

| FUNCTION | MATERIAL | DENSITY (LB/CU IN) | WEIGHT (LB) | VOLUME (CU IN) |
|---|---|---|---|---|
| Ballast/KE | Tungsten | 0.695 | 20.329 | 29.250 |
| Structure, Metal Augmented Charge ("MAC") Explosive | Aluminum | 0.090 | 0.270 | 3.000 |
| Dome | Pyrex | 0.074 | 0.167 | 2.250 |
| Structure | Steel | 0.260 | 1.430 | 5.500 |
| Guidance | Misc Electronics | 0.033 | 0.800 | 24.000 |
| Primary Explosive | Polymer Bonded Explosive ("PBX") | 0.057 | 2.040 | 36.000 |
| Total | SSW | 0.250 | 25.036 | 100.000 |
| MK-76 | | 0.250 | 25.000 | 100.000 |

In the above example, the weapon is MK-76 derived, but others such as BDU-33 are well within the broad scope of the present invention. The weapon provides for very low cost of aircraft integration. The warhead 240 is large enough for useful warheads and small enough for very high carriage density. The modular design of the weapon allows many variants and is compatible with existing handling and loading methods.

The following TABLEs 2 and 3 provide a comparison of several weapons to accentuate the advantages of small smart weapons such as the MK-76 and BDU-33.

TABLE 2

| CANDIDATE | AIRCRAFT ("A/C") CLEARED | WEIGHT (LB) | DIAMETER (IN-APPROX) | REMARKS |
|---|---|---|---|---|
| LGB/MK-81 | None | 250+ | 10 | Canceled variant |
| MK-76/BDU33 | All | 25 | 4 | Low drag practice bomb |
| BDU-48 | All | 10 | 3.9 | High drag practice bomb |
| MK-106 | All | 5 | 3.9 | High drag practice bomb |
| SDB | Most US | 285 | 7.5 | GBU-39 Small Dia. Bomb |

TABLE 3

| CANDIDATE | CLEARED ON MANY A/C? | LARGE ENOUGH FOR WARHEAD? | VIABLE FOR EXPORT? | HIGH DENSITY CARRIAGE? | COMPATIBLE WITH TUBE LAUNCH? |
|---|---|---|---|---|---|
| LGB/MK-81 | No | Yes | Yes | No | No |
| MK-76/BDU33 | All | Yes | Yes | Yes | Yes |
| BDU-48 | All | No | Yes | Yes | Yes |

TABLE 3-continued

| CANDIDATE | CLEARED ON MANY A/C? | LARGE ENOUGH FOR WARHEAD? | VIABLE FOR EXPORT? | HIGH DENSITY CARRIAGE? | COMPATIBLE WITH TUBE LAUNCH? |
|---|---|---|---|---|---|
| MK-106 | All | No | Yes | Yes | Yes |
| SDB | Most US | Yes | No | Yes | No |

The aforementioned tables provide a snapshot of the advantages associated with small smart weapons, such as, procurements are inevitable, and the current weapons have limited utility due to political, tactical, and legal considerations. Additionally, the technology is ready with much of it being commercial off-the-shelf technology and the trends reflect these changes. The smart weapons are now core doctrine and contractors can expect production in very large numbers. Compared to existing systems, small smart weapons exhibit smaller size, lower cost, equally high or better accuracy, short time to market, and ease of integration with an airframe, which are key elements directly addressed by the weapon disclosed herein. As an example, the small smart weapon could increase an unmanned combat air vehicle ("UCAV") weapon count by a factor of two or more over a small diameter bomb ("SDB") such as a GBU-39/B.

The small smart weapons also address concerns with submunitions, which are claimed by some nations to fall under the land mine treaty. The submunitions are a major source of unexploded ordnance, causing significant limitations to force maneuvers, and casualties to civilians and blue forces. Submunitions are currently the only practical way to attack area targets, such as staging areas, barracks complexes, freight yards, etc. Unexploded ordnance from larger warheads are a primary source of explosives for improvised explosive devices. While the broad scope of the present invention is not so limited, small smart weapons including small warheads, individually targeted, alleviate or greatly reduce these concerns.

Figure 3:
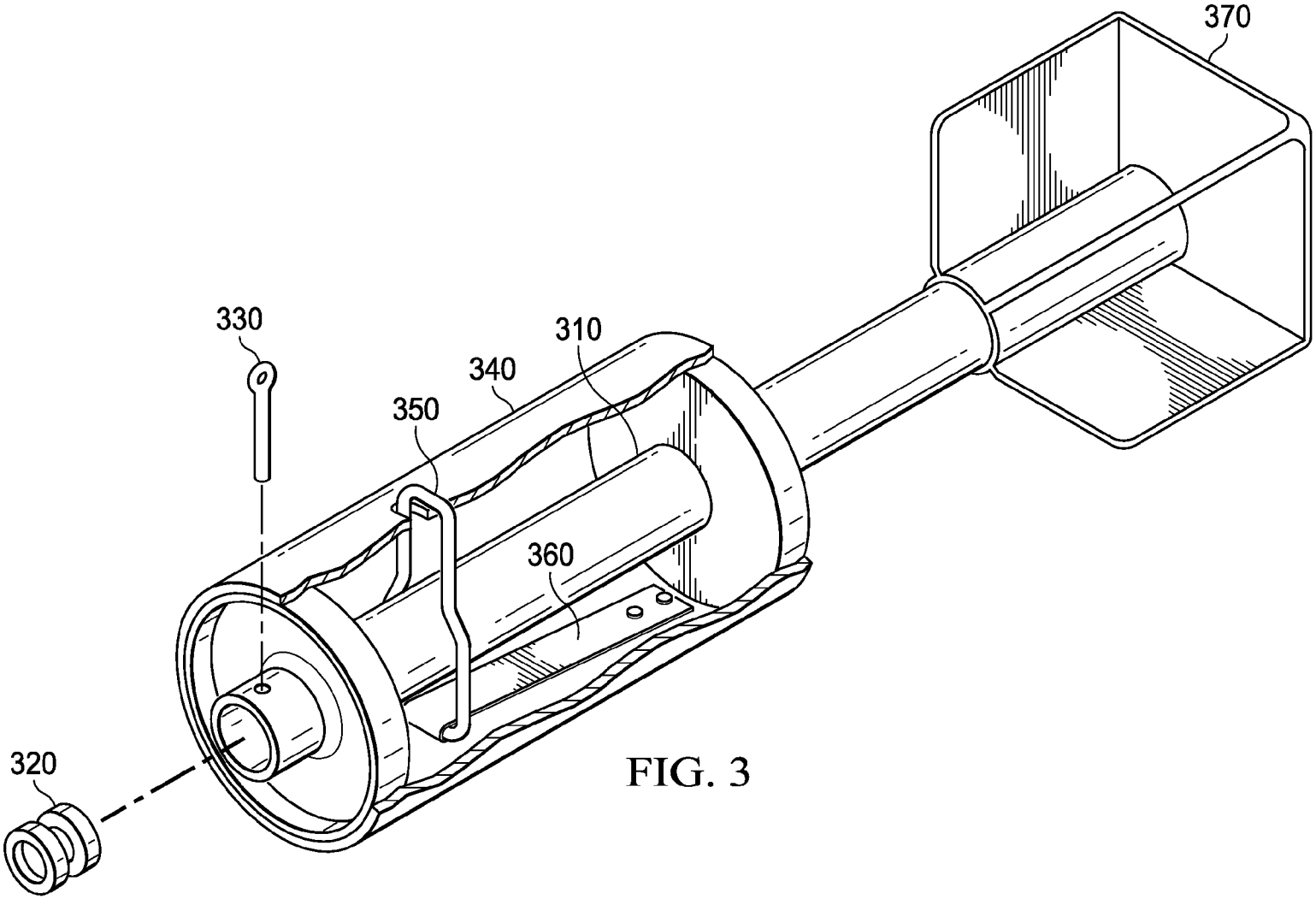
FIG. 3 illustrates a perspective view of an embodiment of a weapon employable in a weapon system.

Turning now to FIG. 3, illustrated is a perspective view of an embodiment of a weapon employable in a weapon system. The weapon is a practice bomb including marker cartridges to provide a visual signal indicating the location of impact. These cartridges are often called signal cartridges 310. The signal cartridges 310 provide a flash, smoke (or smoke like signal) and/or a dye effect, providing a mechanism for locating the impact of a practice bomb in daylight, in darkness and in water. The terms "signal cartridge," "marker cartridge" and "cartridge" may be used interchangeably. A momentum of the practice bomb on impact drives the signal cartridge 310 into a firing pin 320. A primer in the signal cartridge 310 is engaged by the firing pin 320, initiating the signal. A cotter pin (or safety pin) 330 provides a mechanism of "safeing" the round.

A body assembly 340 of the practice bomb may be attached to a delivery vehicle by a suspension lug 350 coupled to a tension spring 360. A tail fin 370 assists with the aerodynamics as the practice bomb is guided toward a target. An example of a practice bomb is a BDU-48/B form factor practice bomb. As evident in the illustrated embodiment, the configuration of the practice bomb employs a forward section thereof for the signal cartridge 310 and the supporting elements.

Figure 4:
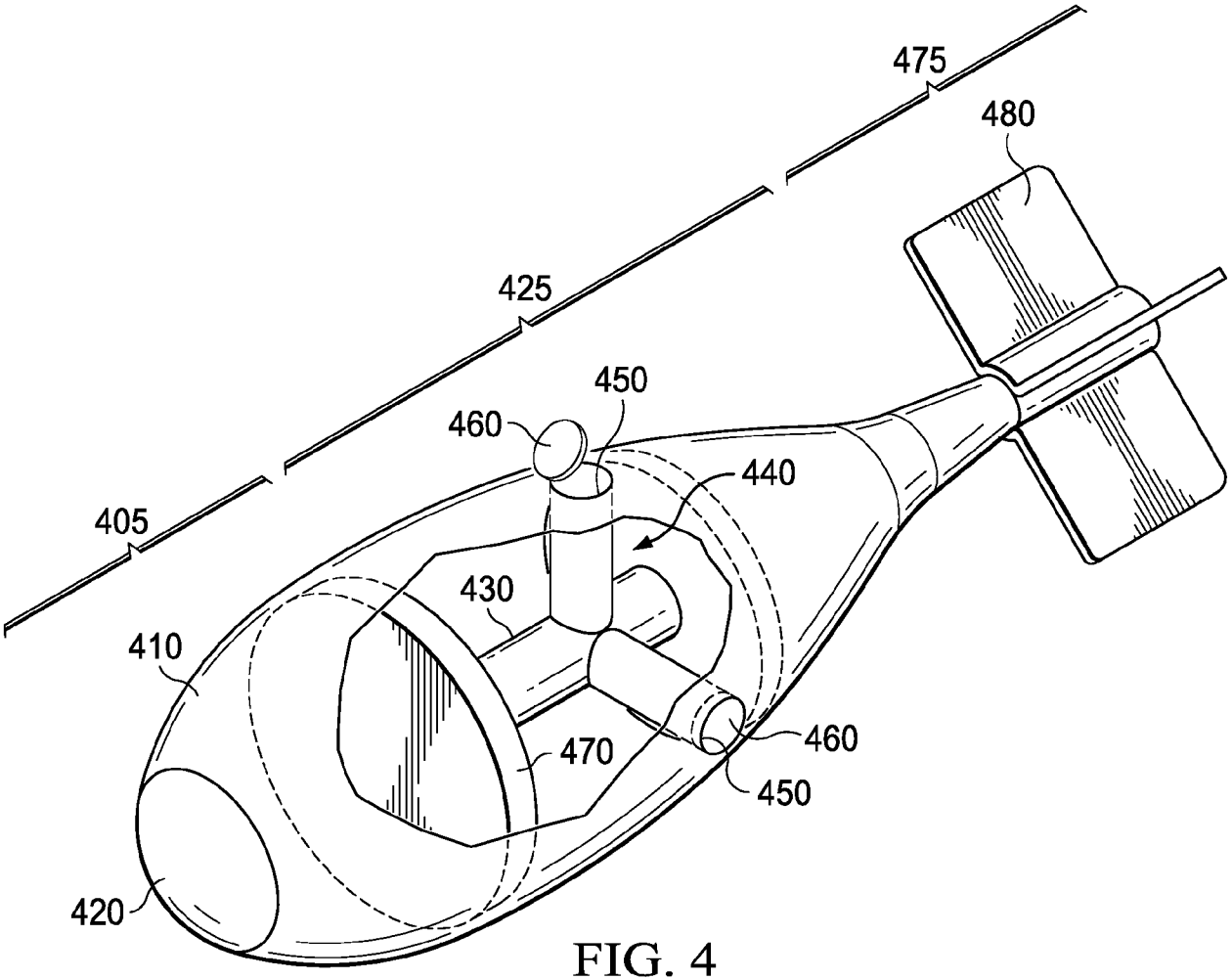
FIGS. 4 to 6 illustrate views of another embodiment of a weapon employable in a weapon system.
Figure 5:
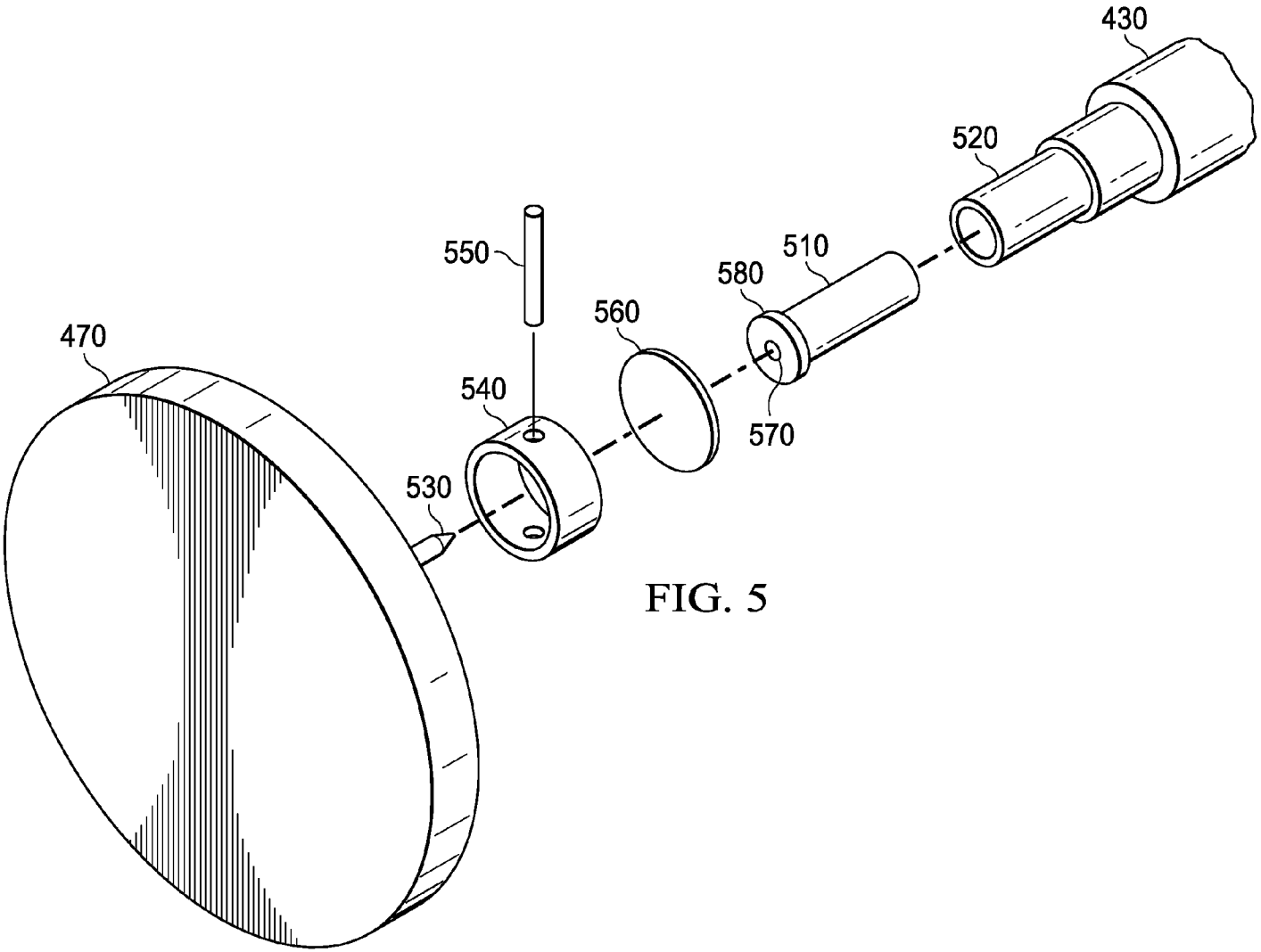
Figure 6:
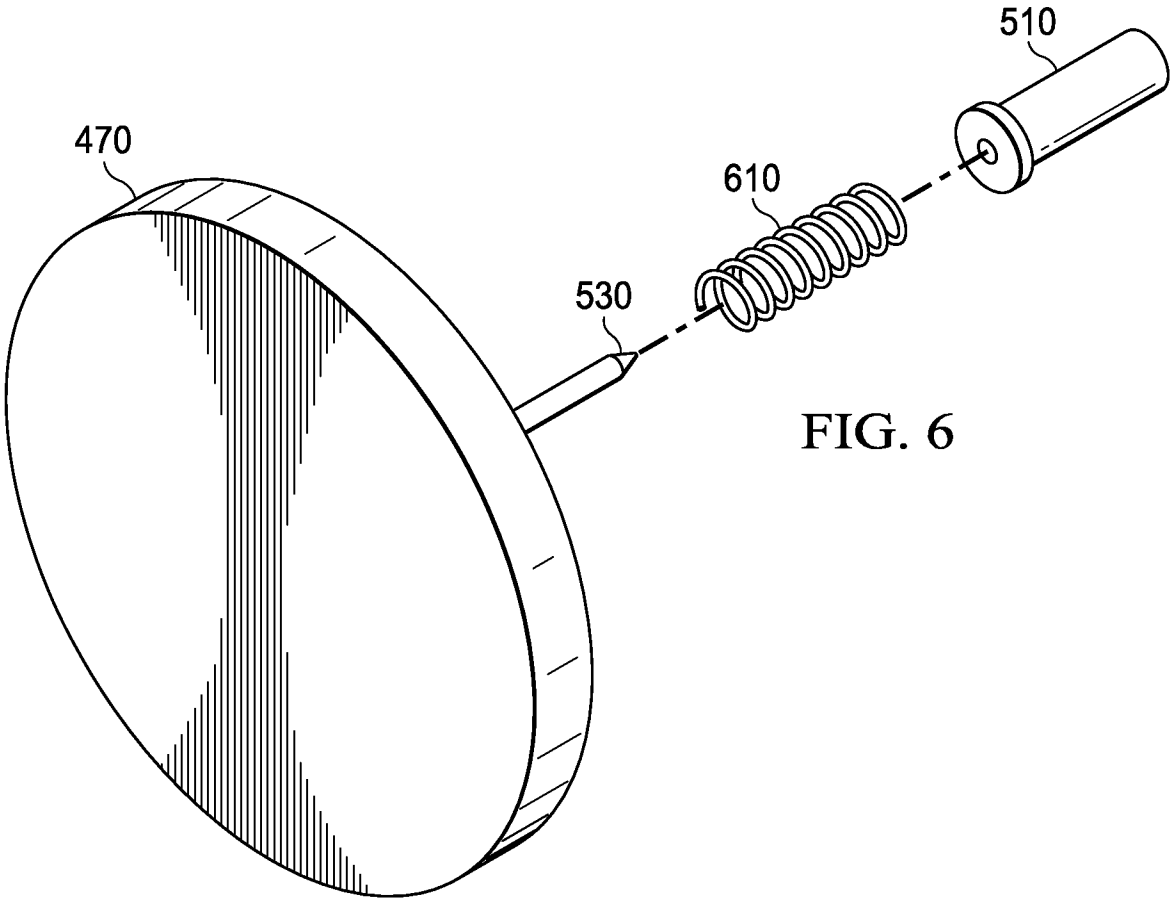

Turning now to FIGS. 4 to 6, illustrated are views of another embodiment of a weapon employable in a weapon system. Beginning with the side, cut away view of FIG. 4, the weapon includes a guidance section 410 including a target sensor (e.g., a laser seeker) 420, and guidance and control electronics and logic to guide the weapon to a target in a front section 405 of a practice bomb embodying the weapon. The guidance section 410 may be analogous to the guidance section 210 described with respect to FIG. 2 above. A signal cartridge 510 (see FIGS. 5 and 6) is installed in a signal cartridge assembly within a containment tube 430. The signal cartridge assembly includes a manifold 440 that provides multiple orifices 450 for the signal indication to escape the practice bomb embodying the weapon. Orifice seals 460 close each orifice 450 prior to the signal cartridge 510 firing, and are blown out by expanding gas of the signal cartridge 510 upon firing. As illustrated, one of the orifice seals 460 is open and the other is closed. The signal cartridge 510 and related assembly is located in a mid-section 425 of the practice bomb. The practice bomb still further includes an aft section 475 behind the mid-section 425 including system power elements, a ballast, actuators, flight control elements, and tail fins 480.

With continuing reference to FIGS. 5 and 6, within the containment tube 430, a sliding mass (or weight) 520 of the signal cartridge assembly provides a mechanism to drive the signal cartridge 510 into a firing pin such as a fixed firing pin 530. The firing pin 530 is affixed to a bulkhead (or hardstop) 470 of sufficient strength to anchor the mechanism. The firing pin 530 is surrounded by a spacer and safety pin positioner 540 also affixed to the bulkhead 470 for engaging a safety or cotter pin 550. The safety pin 550 should be removed prior to the mission flight by the practice bomb. A frangible disc 560 engages (coupled between) the spacer and safety pin positioner 540 and the containment tube 430. Upon an impact of sufficient force, the firing pin 530 engages a primer 570 proximate a signal cartridge rim 580, discharges the signal cartridge 510, and a signal occurs.

Note that the practice bomb preserves the ability to use existing signal cartridges 510. This is a desirable attribute because the signal cartridges 510 can be manufactured in a manner similar to shotgun shells, and are both mature and inexpensive. As illustrated in FIG. 6, the firing pin 530 and standoff spring 610 constitute a firing pin assembly, anchored on the bulkhead 470. The standoff spring 610 is of sufficient stiffness to prevent the signal cartridge 510 from engaging the firing pin 530 in the event of normal vibrations and shocks after the safety pin 550 has been removed. Normal vibration and shock are sufficiently less than the shock of impact to allow for a safety band of range to exist between normal shock and vibration and the shock of impact. The stiffness of the standoff spring 610 is designed to be sufficient to prevent any firing pin 530 contact under normal conditions, but to be reliably overcome by the acceleration of the signal cartridge 510 due to impact such that the signal cartridge 510 strikes the firing pin 530 with sufficient force to fire the signal cartridge 510. An engaged safety pin 550 prevents the firing pin 530 from engaging the primer 570.

Thus, a weapon system with a weapon in the form of a practice bomb, and methods of manufacturing and operating the same have been introduced herein. The weapon includes a guidance section in a front section thereof and a signal cartridge assembly in a mid-section of the weapon. The weapon discloses how a signal cartridge can be inserted therein whose front section may not be available for conventional insertion of the signal cartridge. The weapon incorporates the signal cartridge without compromising the overall dynamics of the weapon, thereby rendering the weapon as a valuable test device of lesser cost and greater safety.

Additionally, exemplary embodiments of the present invention have been illustrated with reference to specific components. Those skilled in the art are aware, however, that components may be substituted (not necessarily with components of the same type) to create desired conditions or accomplish desired results. For instance, multiple components may be substituted for a single component and vice-versa. The principles of the present invention may be applied to a wide variety of weapon systems. Those skilled in the art will recognize that other embodiments of the invention can be incorporated into a weapon system employing a weapon in the form of a practice bomb with a signal cartridge that provides a visual indication of a location of impact for the weapon.

As described above, the exemplary embodiments provide both a method and corresponding apparatus consisting of various modules providing functionality for performing the steps of the method. The modules may be implemented as hardware (including an integrated circuit such as an application specific integrated circuit), or may be implemented as software or firmware for execution by a computer processor. In particular, in the case of firmware or software, the exemplary embodiment can be provided as a computer program product including a computer readable storage structure or medium embodying computer program code (i.e., software or firmware) thereon for execution by the computer processor.

Although the present invention has been described in detail, those skilled in the art should understand that they can make various changes, substitutions and alterations herein without departing from the spirit and scope of the invention in its broadest form. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed, that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A weapon, comprising:

a guidance section including a target sensor in a front section of said weapon;

a signal cartridge assembly behind said front section and including a sliding mass within a containment tube configured to drive a signal cartridge into a firing pin upon impact, said firing pin being surrounded by a spacer and safety pin positioner engaging a safety pin and said signal cartridge being configured to provide a signal indicating a location of impact for said weapon.

2. The weapon as recited in claim 1 wherein said signal cartridge assembly is in a mid-section of said weapon.

3. The weapon as recited in claim 1 wherein said containment tube is oriented toward said guidance section.

4. The weapon as recited in claim 1 wherein said sliding mass is configured to drive said signal cartridge into said firing pin coupled to a bulkhead upon impact.

5. The weapon as recited in claim 1 wherein said spacer and safety pin positioner is coupled to said containment tube via a frangible disc.

6. The weapon as recited in claim 1 wherein said firing pin is configured to engage a primer proximate a signal cartridge rim of said signal cartridge upon impact.

7. The weapon as recited in claim 1 wherein said signal cartridge assembly comprises a manifold configured to provide an orifice for said signal to escape said weapon.

8. The weapon as recited in claim 7 wherein said signal cartridge assembly comprises an orifice seal configured to close said orifice prior to firing said signal cartridge.

9. A weapon system, comprising:

a delivery vehicle; and a weapon coupleable to said delivery vehicle, comprising:

a guidance section including a target sensor in a front section of said weapon, and a signal cartridge assembly behind said front section and including a sliding mass within a containment tube configured to drive a signal cartridge into a firing pin upon impact, said firing pin being surrounded by a spacer and safety pin positioner engaging a safety pin and said signal cartridge being configured to provide a signal indicating a location of impact for said weapon.

10. The weapon system as recited in claim 9 wherein said signal cartridge assembly is in a mid-section of said weapon.

11. The weapon system as recited in claim 9 wherein said containment tube is oriented toward said guidance section.

12. The weapon system as recited in claim 9 wherein said sliding mass is configured to drive said signal cartridge into said firing pin coupled to a bulkhead upon impact.

13. The weapon system as recited in claim 9 wherein said spacer and safety pin positioner is coupled to said containment tube via a frangible disc.

14. The weapon system as recited in claim 9 wherein said firing pin is configured to engage a primer proximate a signal cartridge rim of said signal cartridge upon impact.

15. The weapon system as recited in claim 9 wherein said signal cartridge assembly comprises a manifold configured to provide an orifice for said signal to escape said weapon.

16. The weapon system as recited in claim 15 wherein said signal cartridge assembly comprises an orifice seal configured to close said orifice prior to firing said signal cartridge.

* * * * *